US005341070A

United States Patent [19]

Son

[11] Patent Number: 5,341,070

[45] Date of Patent: Aug. 23, 1994

[54] ELECTRON GUN FOR A COLOR CATHODE RAY TUBE

[75] Inventor: Wan-jae Son, Suwon, Rep. of Korea

[73] Assignee: Samsung Electron Devices Co., Ltd., Kyungki-do, Rep. of Korea

[21] Appl. No.: 18,309

[22] Filed: Feb. 16, 1993

[30] Foreign Application Priority Data

May 19, 1992 [KR] Rep. of Korea ..... 92-8470
May 19, 1992 [KR] Rep. of Korea ..... 92-8471

[51] Int. Cl.[5] ..... G09G 1/04; H01J 29/46; H01J 29/50

[52] U.S. Cl. ..... 315/382; 315/14; 313/414

[58] Field of Search ..... 315/382, 14–15; 313/414

[56] References Cited

U.S. PATENT DOCUMENTS 5,025,189 6/1991 Son ..... 313/414
5,036,258 7/1991 Chen et al. ..... 315/382
5,038,073 8/1991 Son ..... 313/414
5,066,887 11/1991 New ..... 313/414
5,164,640 11/1992 Son et al. ..... 315/382

*Primary Examiner*—Gregory C. Issing
*Attorney, Agent, or Firm*—Leydig, Voit & Mayer

[57] ABSTRACT

An electron gun for a color cathode ray tube includes a cathode, a control electrode and a screen electrode constituting a prepositioned triode. First, second, third and fourth focus electrodes form two pre-focus lenses and a final accelerating electrode positioned adjacent to the fourth focus electrode forms a main focus lens. The first pre-focus lens is synchronous with a deflection signal. Variation of the focussing intensity of the main focus lens is compensated for by the first pre-focus lens.

19 Claims, 2 Drawing Sheets 10a
400a
Ve
18a
300a
17a
17Ha
16a" 17a"
200a
16Ha'
16a
16Ha
14a' 16a'
102a
15a
100a
101a
14a
14Ha
13a
12a
11a
Vd
Vf
Vs
II
II 10b
400b
18b
300b
17b
17Hb
16b" 17b'
200b
16Hb'
16b
16Hb
14b' 16b'
102b
15b
100b
101b
14b
14Hb
13b
12b
11b
Vd
Vf
Vs
III
III

ELECTRON GUN FOR A COLOR CATHODE RAY TUBE

BACKGROUND OF THE INVENTION

The present invention relates to a color cathode ray tube, and more particularly to an electron gun for a color cathode ray tube having double dynamic quadruple pre-focus lenses.

Generally, an electron gun for a cathode ray tube is installed in the neck portion of a funnel to face a screen formed on a panel. In order to improve the resolution of the cathode ray tube, an electron beam emitted from the electron gun is precisely guided to the target position, and particularly, the size of the electron beam spot formed on the screen should be as small as possible. However, since the screen of the cathode ray tube consists of locally varying geometrical curvatures and, at the same time, the R, G and B electron beams proceed in one plane and are initially separated from one another by a predetermined distance, a beam spot of the three electron beams has differing sizes and shapes when respectively formed in the center and peripheral portions of the screen.

Particularly, since the distance from the electron gun to the peripheral portion of the screen is further than that from the electron gun to the center portion of the screen, the focal distance of three electron beams will be different. This difference in focal distance creates a distorted beam spot when the electron beam is guided to the peripheral portion of the screen by the magnetic field of a deflection yoke. The electron beam spot of the peripheral portion of the distorted screen is horizontally elongated. More particularly, a halo is generated around the beam spot, so that a sharp picture cannot be formed. Therefore, the cathode ray tube having such a beam landing structure cannot generate a good picture.

FIG. 1 illustrates a conventional electron gun suggested to improve the aforementioned problem. The electron gun is a dynamic focusing type having a quadruple pre-focus lens whose intensity is changed dynamically. A cathode 2, a control electrode 3 and a screen electrode 4 are placed in the front part of an electron gun 1, composing the prepositioned triode as a source for generating electron beams. First, second, third and fourth focus electrodes 5, 6, 7 and 8 are installed in order, forming the pre-focus lenses of a primary lens system which accelerates and focuses electron beams. A final accelerating electrode 9 is positioned adjacent to fourth focus electrode 8, constituting a main lens with fourth focus electrode 8.

In a conventional electron gun, three horizontally elongated electron beam passing holes 7H are arranged in-line on electron beam outlet **7*b* of third focus electrode 7, and three vertically elongated electron beam passing holes 8G are arranged in-line on electron beam inlet 8*a* of fourth focus electrode 8 which is opposed to electron beam outlet 7*b*. A predetermined static screen voltage Vs is supplied to screen electrode 4 and second focus electrode 6, while a static focus voltage Vf, having a higher potential than that of screen voltage Vs, is supplied to first focus electrode 5 and third focus electrode 7. A parabolic dynamic focus voltage Vd, having a minimum potential which is equal to static focus voltage Vf, is supplied to fourth focus electrode 8 where a deflection signal is synchronized. A static anode voltage Ve having a higher potential than that of focus voltage Vf is supplied to second focus voltage 6**.

According to the above voltage supplying structure, a static pre-focus lens 40 of a uni-potential type is formed by first, second and third focus electrodes 5, 6 and 7. A dynamic quadruple pre-focus lens 50 of a bipotential type is formed between third and fourth focus electrodes 7 and 8, while a dynamic main focus lens 60 is formed between fourth focus electrode 8 and final accelerating electrode 9.

Accordingly, thermions emitted from cathode 2 pass through control electrode 3 and screen electrode 4 and form an electron beam which passes through the main lens system and is focused and accelerated, and proceeds toward the screen. Here, when the electron beam is projected to the central part of the screen formed inside the panel, dynamic focus voltage Vd, synchronized with the deflection signal, is equipotential with the static focus voltage Vf, so that lens 50 cannot be formed between third and fourth focus electrodes 7 and 9. Therefore, the electron beam passes through final main lens 60 formed by fourth focus electrode 8 and final accelerating electrode 9 without any effect, and is finally accelerated, focused and guided to the central part of the screen. Since the electron beam is not influenced by dynamic lens 50, a good beam spot having a round cross section is formed.

Also, since dynamic focus voltage Vd is synchronized with the deflection signal, fourth focus electrode 8 has a potential which is greater than static focus voltage Vf when the electron beam is deflected towards peripheral parts of the screen and dynamic quadruple pre-focus lens 50 is formed between third and fourth focus electrode 7 and 8. Accordingly, the electron beam is projected through main focus lens 60 in such a manner that its cross section is vertically elongated. At this time, the intensity of the main focus lens is changed by dynamic focus voltage Vd, so that the intensity of the main focus lens is weaker when the electron beam is guided toward the peripheral part of the screen than when it is guided toward the central part. Therefore, when passing through the main focus lens, the vertically elongated electron beam has a relatively weak focus and acceleration, so that the focal distance becomes longer than when it is guided toward the central part of the screen. As a result, if the vertically elongated electron beam lands on the periphery of the screen, a beam spot having a relative small halo is formed, as in the case when the electron beam lands on the central part of the screen.

However, since in such a conventional electron gun as mentioned above, the intensity of the final main focus lens is changed by the dynamic focus electrode the electron beam passing through the intensity-altered main lens has a different focus acceleration according to its landing position. Therefore, when the electron beam is deflected to the peripheral part of the screen and vertically elongated by the dynamic quadruple pre-focus lens the electron beam undergoes weak focusing and acceleration. Accordingly, after the electron beam passes through the deflection magnetic field of the deflection yoke, due to the influence of the non-uniform deflection magnetic field exerting horizontal focusing and diverging forces, a horizontally elongated beam spot is formed having a different size than the electron beam spot formed on the center of the screen. As a result, beam spots having relatively small halos can be formed on the screen as a whole, but the beam spot sizes are, as a rule, not uniform on the screen, and a good quality picture is difficult to realize.

SUMMARY OF THE INVENTION

The object of the present invention is to provide an electron gun for a cathode ray tube having double dynamic quadruple pre-focus lenses, capable of forming a beam spot having a uniform size across a screen as a whole and realizing a good quality picture.

To achieve the above object, there is provided an electron gun for a color cathode ray tube comprising:

a cathode;

a control electrode adjacent to and spaced from said cathode;

a screen electrode adjacent to and spaced from said control electrode, said cathode, said screen electrode and said control electrode together constituting a triode which generates an electron beam;

first, second, third and fourth electrodes arranged sequentially;

an accelerating electrode adjacent to and spaced from said fourth electrode;

a first dynamic quadruple pre-focus lens positioned between said first and second electrodes;

a second dynamic quadruple pre-focus lens positioned between said second and third electrodes;

a main lens positioned between said fourth electrode and said accelerating electrode;

means for varying the intensity of said first dynamic quadruple pre-focus lens;

means for varying the intensity of said second dynamic quadruple pre-focus lens; and means for varying the intensity of said main lens.

One embodiment of the electron gun according to the present invention as above is characterized in that:

horizontally elongated electron beam passing holes are formed on the outlet of the first electrode and the inlet of the fourth electrode, while vertically elongated electron beam passing holes are formed on the inlet and outlet of the third focus electrode;

a predetermined screen voltage is supplied to the screen electrode;

a static focus voltage which has a higher potential than that of the screen voltage is supplied to the third focus electrode;

a dynamic focus voltage which is synchronized with the deflection signal and which has the a minimum potential equal to the potential of the focus voltage is supplied to the first and fourth focus electrodes which are electrically connected to each other; and the second focus electrode and the final accelerating electrode are electrically connected to each other and are supplied with an anode voltage.

Another embodiment of the electron gun according to the present invention is characterized in that:

vertically elongated electron beam passing holes are formed on the outlets of the first and third focus electrodes, while horizontally elongated electron beam passing holes are formed on the inlets of the third and fourth focus electrodes;

the screen electrode and the second focus electrode are electrically connected to each other and are supplied with a predetermined screen voltage;

a static focus voltage which has a higher potential than that of the screen voltage is supplied to the third focus electrode;

a dynamic focus voltage whose minimum potential is equal to the potential of the static focus voltage is supplied to the first and fourth focus electrodes; and an anode voltage which has a large potential is supplied to the final accelerating electrode.

BRIEF DESCRIPTION OF THE DRAWINGS

Further features and advantages will become more apparent from the following detailed description of the invention and the accompanying drawings in which the same reference characters generally refer to like parts throughout the views, and in which.

DETAILED DESCRIPTION OF THE INVENTION

The electron gun according to the present invention basically adopts an ordinary dynamic focus method. The dynamic focus type electron gun has double dynamic quadruple pre-focus lenses synchronous to the deflection signal supplied to the deflection yoke. The double dynamic quadruple pre-focus lenses are formed by a dynamic focus voltage varied according to the landing position of an electron beam. Particularly, progressing from a conventional dynamic focus gun, the electron gun of the present invention adopts a double dynamic quadruple pre-focus type lens system having two lenses that complement each other. Between these two dynamic quadruple pre-focus lenses, A first quadruple dynamic focus lens is positioned (hereinafter referred to as a first pre-focus lens) adjacent to a prepositioned triode. This first pre-focus lens is used to compensate for the variation of the main focus lens caused by a second dynamic quadruple pre-focus lens (hereinafter referred to as a second pre-focus lens). Thus, a beam spot which as a whole has a small halo and a uniform size is produced on the screen.

Figure 1:
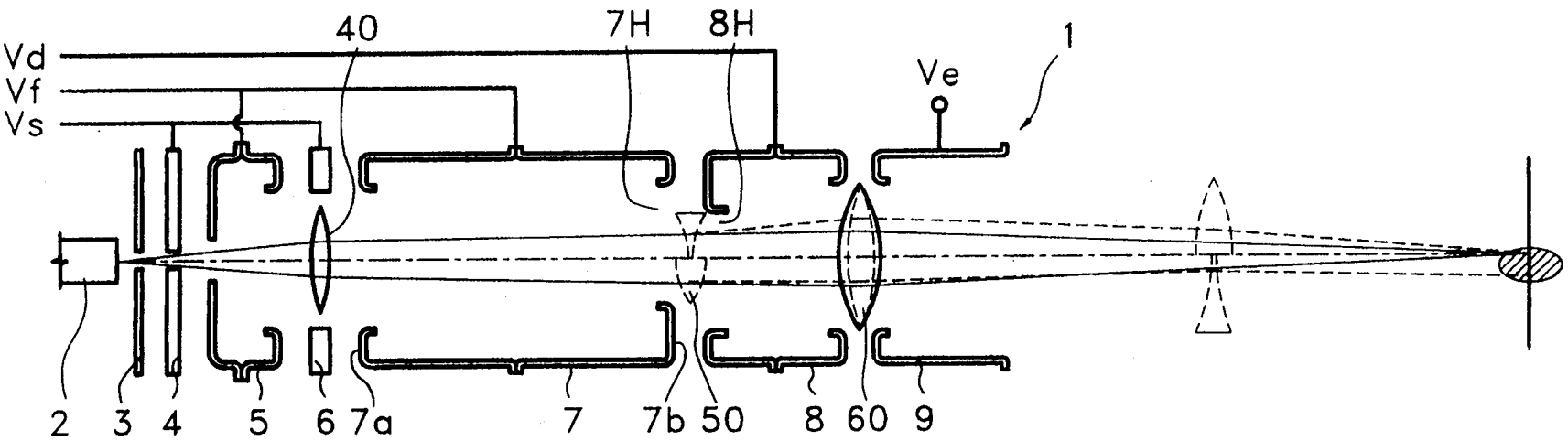
FIG. 1 (PRIOR ART)
FIG. 1 is a schematic cross-sectional view of an electron gun for a conventional cathode ray tube.
Figure 2:
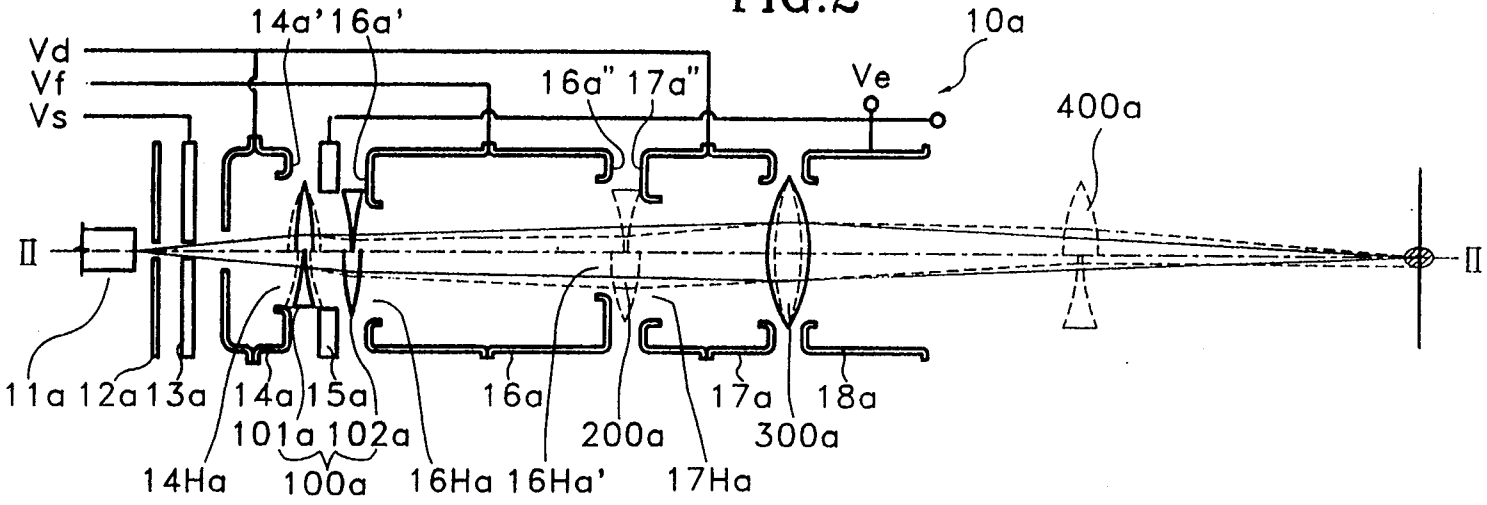
FIG. 2 is a schematic cross-sectional view of an electron gun for a cathode ray tube according to one embodiment of the present invention.
Figure 3:
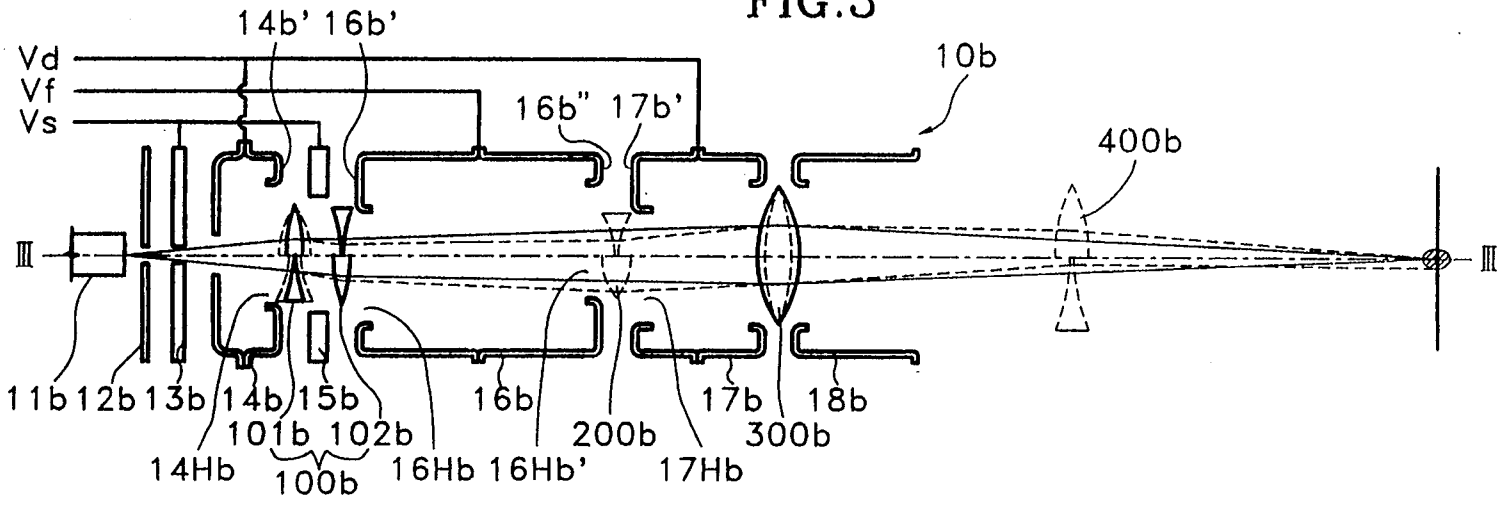
FIG. 3 is a schematic cross-sectional view of an electron gun for a cathode ray tube according to another embodiment of the present invention.

In both FIGS. 2 and 3 which illustrate the embodiments of the present invention, those portions above central lines II—II and III—III show a vertical cross section of the electron gun, while the lower portions depict the electron gun cut horizontally. Therefore, the electron beam trace shown above the central line is an electron beam trace in the vertical direction, and the electron beam trace shown below the central line is an electron beam trace in the horizontal direction.

FIRST EMBODIMENT

Referring to FIG. 2, an electron gun for a color cathode ray tube 10*a* comprises a cathode 11*a*, a control electrode 12*a* and a screen electrode 13*a* together constituting a triode for generating electron beams. First, second, third and fourth electrodes 14*a*, 15*a*, 16*a* and 17*a* form two pre-focus lenses, and a final accelerating electrode 18*a* forms a main focus lens in cooperation with the fourth electrode 17*a*.

Horizontally elongated electron beam passing holes 14Ha and 17Ha are formed in an electron beam outlet 14*a*′ of first focus electrode 14*a* and an electron beam inlet 17*a*′ of fourth focus electrode 17*a*, while vertically elongated electron beam passing holes 16Ha and 16Ha′ are formed in an inlet 16a' and an outlet 16a'' of third focus electrode 16a.

Meanwhile, a predetermined static screen voltage Vs is supplied to screen electrode 13a, and a static focus voltage Vf is supplied to third focus electrode 16a. A dynamic focus voltage Vd, having a minimum potential which is equal to the potential of focus voltage Vf and which is synchronized with the deflection signal, is supplied to first and fourth focus electrodes 14a and 17a. Second focus electrode 15a is electrically connected to final accelerating electrode 18a and receives an anode voltage Ve which has a potential which is higher than the maximum potential of the dynamic focus voltage Vd. Preferably, the static focus voltage Vf is within the range of 400 V to 800 V and the anode voltage is within the range of 20 kV–35kV. Most preferably, the anode voltage is 27 kV. The static focus voltage Vf is preferably 20–35% of the anode voltage Ve. In addition, the dynamic focus voltage Vd is governed by the following inequality:

$$Vf \leqq Vd \leqq Vf + 2000\ V$$

Given the above-noted voltage values, first, second and third focus electrodes constitute a first pre-focus lens 100a, and third and fourth focus electrodes constitute a second pre-focus lens 200a. A main focus lens 300a is formed by the fourth focus electrode and the final accelerating electrode.

The electron gun for a color cathode ray tube according to the present invention constructed as above is operated in the following manner. As the aforementioned predetermined voltage is supplied to each electrode constituting electron gun 10a, the thermions emitted from cathode 11a pass through the control and screen electrodes to form an electron beam which passes through pre-focus lenses 100a and 200a and main focus lens 300a to be focussed and accelerated, thereby proceeding toward the screen.

The above operation is explained in detail with respect to the following two cases. The first case is where the electron beam lands on the central part of the screen, that is, the focus voltage and dynamic focus voltage maintain equipotential levels. The second case is where the electron beam lands on the periphery of the screen. That is, the dynamic focus voltage Vd maintains a higher potential than the static focus voltage Vf.

A. When the Electron Beam Lands on the Central Dart of the Screen

When the electron beam is projected towards the central part of the screen, the electron beam emitted from the electron gun is not deflected, so that dynamic focus voltage Vd and static focus voltage Vf temporarily maintain the same potential. Accordingly, a first pre-focus lens 100a is formed between first, second and third focus electrodes 14a, 15a and 16a. A main focus lens 300a is formed between fourth focus electrode 17a and final accelerating electrode 18a. However, since third focus electrode 16a and fourth focus electrode 17a have the same potential, a second pre-focus lens 200a is not formed between them. Therefore, the electron beam is focussed and accelerated only by main focus lens 300a formed between the fourth focus electrode and final accelerating electrode 18a, and first pre-focus lens 100a. The first pre-focus lens 100a includes a first auxiliary pre-focus lens 101a formed between first focus electrode 14a and second focus electrode 15a, and a second auxiliary pre-focus lens 102a formed between second focus electrode 15a and third focus electrode 16a.

When passing through first pre-focus lens 100a, the electron beam undergoes vertical focussing and horizontal divergence by first auxiliary pre-focus lens 101a formed by a horizontally elongated electron beam passing hole 14H of outlet 14a' of first focus electrode 14a. The electron beam also undergoes strong horizontal focussing and vertical divergence by second auxiliary pre-focus lens 102a formed by a vertically elongated electron beam passing hole 16Ha of the inlet of third focus electrode 16a.

The electron beam is vertically and horizontally elongated as well as being focussed and accelerated when it passes through first auxiliary pre-focus lens 101a and second auxiliary pre-focus lens 102a of first pre-focus lens 100a, respectively. Therefore, the electron beam passes through the first auxiliary pre-focus lens 101a while maintaining almost the same cross-sectional shape as before being incident to first auxiliary pre-focus lens 101a. The electron beam is focussed and accelerated as it passes through the first pre-focus lens 100a and the third and fourth focus electrodes 16a and 17a which maintain an equipotential with each other. Finally, the electron beam passes through main focus lens 300a constituted by fourth focus electrode 17a and final accelerating electrode 18a where it is accelerated, focussed, and directed toward the central part of the screen. As a result, a substantially round electron beam spot is formed on the screen.

B. When the Electron Beam Lands on the Peripheral Part of the Screen

When projected to the periphery of the screen, the electron beam emitted from the electron gun is deflected by the deflection yoke (not shown), so that dynamic focus voltage Vd maintains a higher potential than that of static focus voltage Vf. Accordingly, a first pre-focus lens 100a is formed between first, second and third focus electrodes 14a, 15a and 16a, a second pre-focus lens 200a is formed between third and fourth focus electrodes 16a and 17a, and a main focus lens 300a is formed between fourth focus electrode 17a and final accelerating electrode 18a.

The intensity of the first auxiliary pre-focus lens 101a of first pre-focus lens 100a is weakened as compared to the case where the electron beam lands on the central part of the screen. This weakening is engendered because the potential difference between first focus electrode 14a and second focus electrode 15a is reduced compared with the case where the electron beam lands on the central part of the screen. However, since the potential difference between the second and third focus electrodes 15a and 16a is always the same, the intensity of the second auxiliary pre-focus lens 102a is not changed. Therefore, the electron beam is horizontally elongated somewhat due to a strong vertical focussing and horizontal divergence by the first auxiliary pre-focus lens 101a, and a weak vertical divergence and horizontal focussing by the second auxiliary pre-focus lens 101a. When passing through third and fourth focus electrodes 16a and 17a, the electron beam is elongated by the strong second pre-focus lens 200a and, particularly by a vertically elongated electron beam outlet passing hole 16Ha' of third focus electrode 16a.

As the electron beam, elongated as above, passes through a non-uniform magnetic field 400a created by the deflection yoke it experiences vertical focussing and horizontal divergence, and is guided toward the peripheral region of the screen where its horizontal width is widened to thereby form a nearly round beam spot. Here, since the intensity of main focus lens 300a formed between fourth focus electrode 17a and final accelerating electrode 18a by dynamic focus voltage Vd is relatively weak as compared with that of the case when the electron beam is directed to the central part of the screen, the final focus distance is elongated so that the beam spot formed on the periphery of the screen is nearly the same size as that of the electron beam spot formed on the central part of the screen.

SECOND EMBODIMENT

Referring to FIG. 3, an electron gun for a color cathode ray tube 10b comprises a cathode 11b, a control electrode 12b and a screen electrode 13b comprising a triode for generating electron beams. The control electrode 12b and the screen electrode 13b, first, second, third and fourth electrodes 14b, 15b, 16b and 17b comprise two pre-focus lenses. A final accelerating electrode 18b forms a main focus lens 300b in cooperation with fourth focus electrode 17b.

Vertically elongated electron beam passing holes 14Hb and 17Hb are formed in an electron beam outlet 14b' of first focus electrode 14b and an electron beam outlet 17b' of fourth focus electrode 17b. Horizontally elongated electron beam passing holes 16Hb and 17Hb are formed in an inlet 16b' of third focus electrode 16b and an electron beam inlet 17b' of fourth focus electrode 17b.

Meanwhile, a predetermined static screen voltage Vs is supplied to screen electrode 13b and second focus electrode 15b. Preferably, the static screen voltage lies in a range of between 400 V and 800 V. A static anode voltage Ve is supplied to accelerating electrode 18b. The static anode voltage lies in a range between 20 kV and 35 kV. Preferably the static anode voltage is 27 kV. A static focus voltage Vf, which is preferably between 20% and 35% of the static anode voltage Ve, is supplied to third focus electrode 16b. A dynamic focus voltage Vd which has a minimum potential that is equal to the potential of the static focus voltage Vf and is in synchronization with the deflection signal, is supplied to first and fourth focus electrodes 14b and 17b. The dynamic focus voltage Vd has a maximum potential which is 2000 V greater than the potential of the static focus voltage $V_3$.

Accordingly, first, second and third focus electrodes 14b, 15b, and 16b constitute a first pre-focus lens 100b, and third and fourth focus electrodes 16b and 17b constitute a second pre-focus lens 200b. A main focus lens 300b is formed by the fourth focus electrode 17b and the final accelerating electrode 18b.

The electron gun for a color cathode ray tube according to the present invention constructed as above is operated as follows. As the aforementioned predetermined voltages are supplied to each electrode constituting electron gun 10b, the thermions emitted from cathode 11b pass through the triode to form an electron beam which passes through the pre-focus lenses 100b and 200b and the main focus lens 300b to be focussed and accelerated, thereby proceeding to the screen.

As in the first embodiment, this embodiment is explained with respect to the following two cases. The first case is where the electron beam lands on the center part of the screen. That is, the static focus voltage Vs maintains an equipotential with dynamic focus voltage. The second case is where the electron beam lands on the peripheral region of the screen. That is, the dynamic focus voltage maintains a higher potential than the static focus voltage.

A. When the Electron Beam Lands on the Screen's Central

When the electron beam is projected to the central part of the screen, the electron beam emitted from the electron gun is not deflected, so that dynamic focus voltage Vd and static focus voltage Vf temporarily maintain the same potential. Accordingly, a first pre-focus lens 100b is formed between first, second and third focus electrodes 14b, 15b and 16b. A main focus lens 300b is formed between fourth focus electrode 17b and final accelerating electrode 18b. However, since third focus electrode 16b and fourth focus electrode 17b have the same potential, a second pre-focus lens 200b is not formed between them. The electron beam is focussed and accelerated only by main focus lens 300b and first pre-focus lens 100b. The first pre-focus lens 100b comprises a first auxiliary pre-focus lens 101b formed between first focus electrode 14b and second focus electrode 15b, and a second auxiliary pre-focus lens 102b formed between second focus electrode 15b and third focus electrode 16b.

When passing through first pre-focus lens 100b, the electron beam undergoes a horizontal divergence and strong vertical focussing by first auxiliary pre-focus lens 101b formed by a vertically elongated electron beam passing hole 14Hb of outlet 14b' of first focus electrode 14b. Also, the electron beam undergoes a strong horizontal focussing and a vertical divergence by second auxiliary pre-focus lens 102b formed by a horizontally elongated electron beam passing hole 16Hb of the inlet of third focus electrode 16b.

The electron beam undergoes a vertical and horizontal focussing and divergence, while being focussed and accelerated when passing through first auxiliary pre-focus lens 101b and second auxiliary pre-focus lens 102b of first pre-focus lens 100b, respectively. Consequently, the electron beam passes through the first auxiliary pre-focus lens 101b while maintaining nearly the same cross-sectional shape as that before being incident to first auxiliary pre-focus lens 101b. The electron beam is focussed and accelerated as it passes through the first pre-focus lens 100b and the third and fourth focus electrodes 16b and 17b, which maintain an equipotential with each other. Finally the electron beam passes through the main focus lens 300b constituted by fourth focus electrode 17b and the final accelerating electrode 18b where it is accelerated, focussed, and directed toward the central part of the screen. As a result, a substantially round electron beam spot is formed on the screen.

B. When the Electron Beam Lands on the Screen's Peripheral Region

When projected to the periphery of the screen, the electron beam emitted from the electron gun is deflected by the deflection yoke (not shown), so that dynamic focus voltage Vd maintains a higher potential than that of static focus voltage Vf. Accordingly, a first pre-focus lens 100b is formed between first, second and third focus electrodes 14b, 15b and 16b, a second pre-focus lens 200b is formed between third and fourth focus electrodes 16b and 17b, and a main focus lens 300b is formed between fourth focus electrode 17b and final accelerating electrode 18b.

The intensity of the first auxiliary pre-focus lens 101b of first pre-focus lens 100b is strengthened as compared with when the electron beam is guided to the central part of the screen. This strengthening is engendered because the potential difference between first focus electrode 14b and second focus electrode 15b is increased compared with the case where the electron beam is guided to the central part of the screen. However, since the potential difference between the second and third focus electrodes 15b and 16b is always the same, the intensity of the second auxiliary pre-focus lens 102b does not change. Therefore, like the first embodiment, since the focussing of the second auxiliary pre-focus lens 102b is stronger than that of the first auxiliary pre-focus lens 101b, the electron beam is horizontally elongated. However, when passing through third and fourth focus electrodes 16b and 17b, the electron beam is vertically elongated by the strong second pre-focus lens 200b by a vertically elongated electron beam outlet passing hole 16Hb' of third focus electrode 16b. When the vertically elongated electron beam is passed through the main focus lens 300b and a non-uniform magnetic field created by the deflection yoke (not shown), the beam is directed to the peripheral region of the screen where its horizontal width is widened to thereby form a nearly round beam spot. Here, the intensity of main focus lens 300b formed between fourth focus electrode 17b and final accelerating electrode 18b is relatively weak, due to dynamic focus voltage Vd, compared with when the electron beam lands on the central part of the screen. As a result, the final focus distance is elongated so that the beam spot formed on the periphery of the screen obtains a size almost the same as that of the electron beam spot formed on the central part of the screen.

The electron gun for a color cathode ray tube according to the present invention has double dynamic quadruple pre-focus lenses. The intensity of the first pre-focus lens adjacent to the triode is changed corresponding to the variation of the intensity of the second pre-focus lens, so that the intensity variation of the main focus lens due to that of the second pre-focus lens is compensated by the first pre-focus lens. That is, the electron gun of the present invention forms a beam spot having a minimized halo across the screen, due to the introduction of the dynamic focus method. Here, the intensity variation of the main focus lens is compensated by the first pre-focus lens which complements the main focus lens, so that the focus condition of the electron beam is formed uniformly across the screen. As a result, in the present invention, beam spots with minimized halos and uniform size are formed over the screen as a whole, thereby realizing a good quality picture.

The electron gun of the present invention having a double dynamic focus method is not restricted to the illustrated embodiment. The method can be performed by one of ordinary skill based on this theory, and various modifications may be made within the scope of the appended claims.

What is claimed is:

1. An electron gun for a color cathode ray tube comprising:

a cathode;

a control electrode adjacent to and spaced from said cathode;

a screen electrode adjacent to and spaced from said control electrode, said cathode, said screen electrode and said control electrode together constituting a triode which generates an electron beam;

first, second, third and fourth electrodes arranged sequentially;

an accelerating electrode adjacent to and spaced from said fourth electrode;

a first bipotential dynamic quadruple pre-focus lens positioned between said first and third electrodes;

a second dynamic quadruple pre-focus lens positioned between said third and fourth electrodes;

a main lens positioned between said fourth electrode and said accelerating electrode;

means for varying the intensity of said first bipotential dynamic quadruple pre-focus lens;

means for varying the intensity of said second dynamic quadruple pre-focus lens; and means for varying the intensity of said main lens.

2. An electron gun for a color cathode rat tube as claimed in claim 1 wherein each of said first, second, third and fourth electrodes includes an inlet panel and an outlet panel, the outlet panel of said first electrode and the outlet panel of said fourth electrode having a plurality of horizontally elongated electron beam passing holes.

3. An electron gun for a color cathode ray tube as claimed in claim 2 wherein the inlet panel and the outlet panel of said third electrode include a plurality of vertically elongated electron beam passing holes.

4. An electron gun for a color cathode ray tube as claimed in claim 1 wherein each of said first, second, third and fourth electrodes includes an inlet panel and an outlet panel, the outlet panel of said first electrode and the outlet panel of said fourth electrode having a plurality of vertically elongated electron beam passing holes.

5. An electron gun for a color cathode ray tube as claimed in claim 4 wherein the inlet panel of said third electrode includes a plurality of horizontally elongated electron beam passing holes.

6. An electron gun for a color cathode ray tube as claimed in claim 4 wherein the inlet panel of said fourth electrode includes a plurality of horizontally elongated electron beam passing holes.

7. An electron gun for a color cathode ray tube as claimed in claim 1 wherein said means for varying the intensity of said first bipotential dynamic quadruple pre-focus lens varies the intensity of said first bipotential dynamic quadruple pre-focus lens such that said first bipotential dynamic quadruple pre-focus lens compensates for intensity variation in said main lens.

8. An electron gun for a color cathode ray tube comprising:

a cathode;

a control electrode adjacent to and spaced from said cathode;

a screen electrode adjacent to and spaced from said control electrode, said cathode, said screen electrode and said control electrode together constituting a triode which generates an electron beam;

first, second, third and fourth electrodes arranged sequentially;

an accelerating electrode adjacent to and spaced from said fourth electrode and electrically connected to said second electrode;

means for supplying a screen voltage to said screen electrode;

means for supplying a static focus voltage to said third electrode, the static focus voltage having a higher potential than the screen voltage;

means for supplying a static anode voltage to said second electrode and said accelerating electrode; and means for supplying a dynamic focus voltage to said first and fourth electrodes, the dynamic focus voltage having a minimum potential equal to the potential of the static focus voltage.

9. An electron gun for a color cathode ray tube as claimed in claim 8 wherein the static anode voltage is in the range of 20 kV to 35 kV.

10. An electron gun for a color cathode ray tube as claimed in claim 9 wherein the static anode voltage is 27 kV.

11. An electron gun for a color cathode ray tube as claimed in claim 8 wherein the static focus voltage is in the range of 20% to 35% of the static anode voltage.

12. An electron gun for a color cathode ray tube as claimed in claim 8 wherein the dynamic focus voltage has a peak value equal to the value of the static focus voltage plus 2000 V.

13. An electron gun for a color cathode ray tube comprising:

a cathode;

a control electrode adjacent to and spaced from said cathode;

a screen electrode adjacent to and spaced from said control electrode, said cathode, said screen electrode and said control electrode together constituting a triode which generates an electron beam;

first, second, third and fourth electrodes arranged sequentially, said second electrode being electrically connected to said screen electrode and said first electrode being electrically connected to said fourth electrode;

an accelerating electrode adjacent to and spaced from said fourth electrode;

means for supplying a screen voltage to said screen electrode and said second electrode;

means for supplying a static focus voltage to said third electrode, the static focus voltage having a higher potential than the screen voltage;

means for supplying a static anode voltage to said accelerating electrode; and means for supplying a dynamic focus voltage to said first and fourth electrodes, the dynamic focus voltage having a minimum potential equal to the potential of the static focus voltage.

14. An electron gun for a color cathode ray tube as claimed in claim 13 wherein the static anode voltage is in the range of 20 kV to 35 kV.

15. An electron gun for a color cathode ray tube as claimed in claim 14 wherein the static anode voltage is 27 kV.

16. An electron gun for a color cathode ray tube as claimed in claim 13 wherein the static focus voltage is in the range of 20% to 35% of the static anode voltage.

17. An electron gun for a color cathode ray tube as claimed in claim 13 wherein the dynamic focus voltage has a peak value equal to the value of the static focus voltage plus 2000 V.

18. An electron gun for a color cathode ray tube as claimed in claim 1 wherein said first bipotential dynamic pre-focus lens includes a first auxiliary pre-focus lens formed between said first and second focus electrodes and a second auxiliary pre-focus lens formed between said second and third electrodes.

19. An electron gun for a color cathode ray tube as claimed in claim 18 wherein said means for varying the intensity of said first bipotential dynamic pre-focus lens varies the intensity of the first auxiliary pre-focus lens while maintaining the intensity of the second auxiliary pre-focus lens constant.

* * * * *